United States Patent [19]

Farquharson

[11] 3,984,875

[45] Oct. 12, 1976

[54] PROTECTIVE HEAD GEAR

[75] Inventor: Charles R. Farquharson, Toronto, Canada

[73] Assignee: Canada Cycle and Motor Company Limited, Weston, Canada

[22] Filed: Aug. 28, 1975

[21] Appl. No.: 606,391

[30] Foreign Application Priority Data

July 18, 1975 Canada ..... 231816

[52] U.S. Cl. ..... 2/10

[51] Int. Cl.[2] ..... A41D 13/00

[58] Field of Search ..... 2/10, 9, 14 B, 3 R, 2/6

[56] References Cited

UNITED STATES PATENTS

| | | | |
|---|---|---|---|
| 2,686,912 | 8/1954 | Shipman | 2/9 |
| 3,729,745 | 5/1973 | Latina | 2/9 |
| 3,787,895 | 1/1974 | Belvedere | 2/9 |
| 3,886,596 | 6/1975 | Franklin et al. | 2/9 |
| 3,897,597 | 8/1975 | Kasper | 2/9 |

*Primary Examiner*—Werner H. Schroeder
*Assistant Examiner*—Peter Nerbun

[57] ABSTRACT

Protective head gear is provided of a type used in hockey and other activities to protect a participant against harmful and damaging impacts. The protective head gear has a helmet adapted to cover major portions of the participant's head other than his face, and the helmet includes a peripheral brow portion extending between symmetrically disposed temple portions at either side of the helmet. A mouth guard is included for attachment to the temple portions and is shaped to extend from these portions symmetrically across the participant's mouth. An upper peripheral portion of the mouth guard is aligned generally with the peripheral brow portion for underlying a curved eye shield so that on impact the eye shield will be supported by one or more of these portions.

10 Claims, 4 Drawing Figures

PROTECTIVE HEAD GEAR

This invention relates to protective head gear of a type used in hockey and other activities to protect a participant's head from harmful and damaging impacts.

The following description will be directed to protective head gear of the type used in ice hockey. However, it will be appreciated that such description is exemplary of protective head gear which can be worn when participating in many different activities.

Ice hockey head gear can be broken down into three distinct parts. Firstly, a helmet is provided to protect portions of the head other than the face; secondly a mouth guard is provided to protect the teeth and chin; and thirdly an eye shield is provided.

Many types of hockey helmets have been developed, and these include helmets which are formed in two parts so that they can be adjusted to the users head. Also mouth guards are available which are attached independently of the helmet and positioned about the users mouth and chin. Recently, eye shields have become available for attachment to the helmet. These eye shields depend downwardly from the helmet and suffer from serious disadvantages. Firstly, they are readily deflected by a puck or the like into the user's face, and secondly it is possible for a hockey stick to become lodged between the eye shield and the user's face.

The purpose of the present invention is to provide safer head gear and more particularly to provide head gear which can receive and support an eye shield such that the eye shield cannot be deflected into a user's face without extreme force, and such that a hockey stick cannot become lodged under the eye shield.

Accordingly, protective head gear is provided of a type used in hockey and other activities to protect a participant against harmful and damaging impacts, the protective head gear comprising: a helmet adapted to cover major portions of the participant's head other than his face, the helmet having a peripheral brow portion extending between symmetrically disposed temple portions at either side of the helmet and adapted to extend across the participant's brow above the eyes; a mouth guard attachable to the temple portions and shaped to extend from these portions symmetrically across the participant's mouth and having an upper peripheral portion; and a curved eye shield overlying the peripheral brow portion and said upper peripheral portion such that on impact the eye shield will be supported by one or more of these portions.

The invention will be better understood with reference to the drawings, in which.

Figure 1:
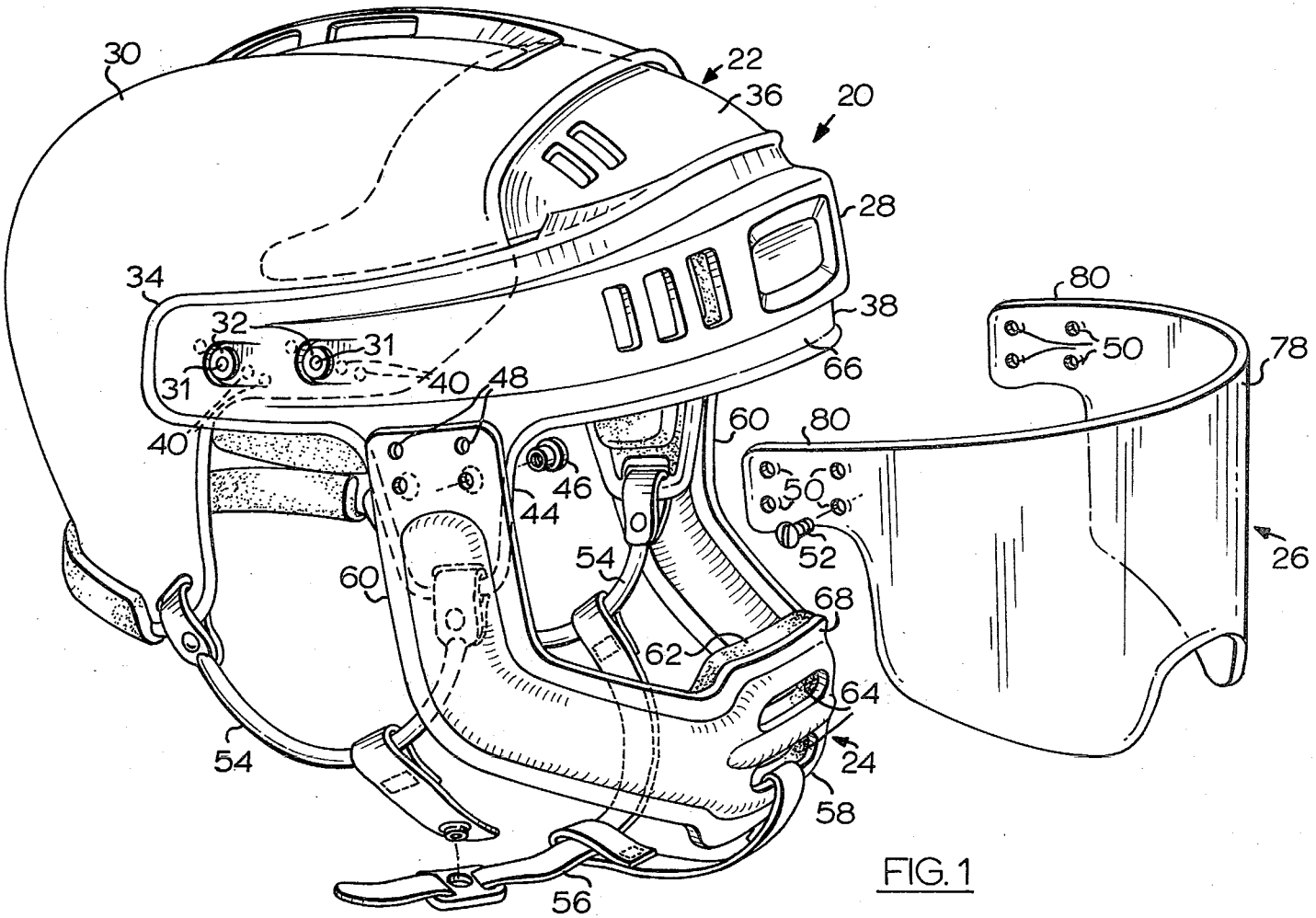
FIG. 1 is a perspective, partially exploded view of protective head gear incorporating a preferred embodiment of the invention.

Reference is first made to FIG. 1 which shows protective head gear 20 comprising a helmet 22, mouth guard 24, and eye shield 26. As will be described, the mouth guard and eye shield are attachable to the helmet 22 to unify the parts into the protective head gear 20.

Figure 2:
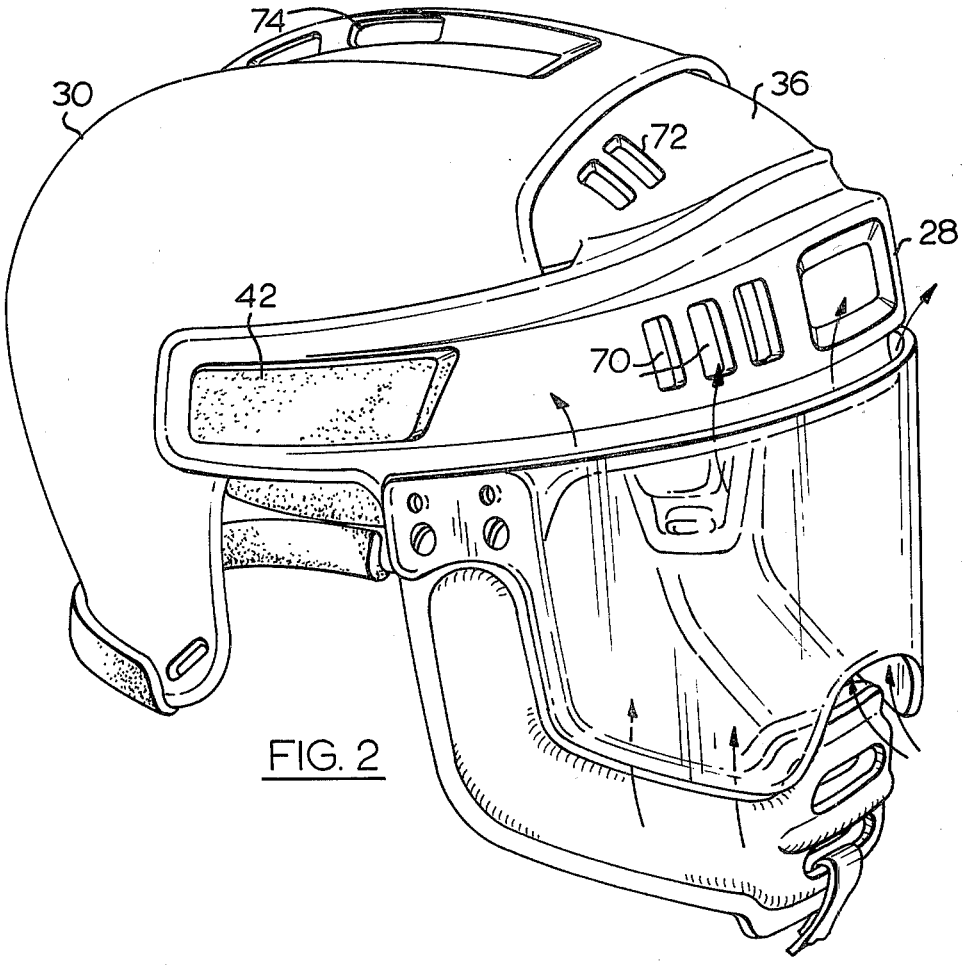
FIG. 2 is a perspective view of the protective head gear in an assembled condition and illustrating air circulation.

As seen in FIG. 1, the helmet 22 includes respective front and rear shells 28, 30 connected to one another by two pairs of screw fasteners 32 (two of which fasteners can be seen) located symmetrically at either side of the helmet 22. The front shell 28 includes a pair of side portions 34 (one of which is shown) and a central portion 36 all of which are rearwardly dependent from a sculptured front portion 38. The side portions 34 extend outside the rear shell 30 whereas the central portions 36 extend inside the the rear shell. Screws 31 can be positioned in a series of openings 40 from inside the rear shell 30 to engage in nuts 32 which are permanently embedded in the front shell 28. The screws 31 and nuts 32 combine to provide a measure of adjustment so that the front and rear shells can be moved relative to one another to better fit the helmet on a user's head. The nuts 32 are pressed into the front shell 28 during manufacture and a resilient cover 42 (FIG. 2) is added so that if this area is impacted by a puck, the fasteners are not impacted directly.

The front shell 28 of helmet 22 also defines a pair of temple portions 44 (one of which is shown) located symmetrically to either side of the helmet and extending downwardly approximately where the side portions 34 meet the front portions 38. Each of the temple portions 44 has four openings adapted to receive threaded elements such as element 46 which engages in the opening in the portion 44 and is flanged to prevent the element passing through this portion. The element is adapted to engage in the opening in portion 44 with sufficient friction that it will not separate readily. Similarly, openings 48 and 50 are provided in the mouth guard 24 and eye shield 26 for alignment with the engaged threaded elements 46 so that screws such as screw 52 can be engaged through the openings to retain the mouth guard 24 and eye shield 26 in position attached to the temple portions 44 of the front shell 28.

The helmet 22 also includes a pair of flexible side pieces 54 dependent one at each side of the helmet from the temple portions 44 and from a lower forward extremity of the rear shell 30. In turn, an adjustable chin strap 56 is dependent from the side pieces 54 for engagement under a user's chin. The arrangement is such that the chin strap 56 can be positioned comfortably under the user's chin.

The mouth guard 24 consists essentially of a front portion 58 for engagement in front of a user's mouth, and a pair of wing portions 60 which are dependent one from either side of the front portion 58. These wing portions extend rearwardly from the front portion 58 and then upwardly terminating in engagement with outer surfaces of the temple portions 44 of the helmet 22. The mouth guard is contoured to improve the mechanical rigidity of the structure and includes padding 62 which can engage about a user's mouth in the event of impact on an outer front surface of the mouth guard. Also, the front portion 58 defines relatively small elongated openings 64 which are aligned with corresponding openings in the padding 62 so that the user can breathe and talk through the mouth guard.

Figure 3:
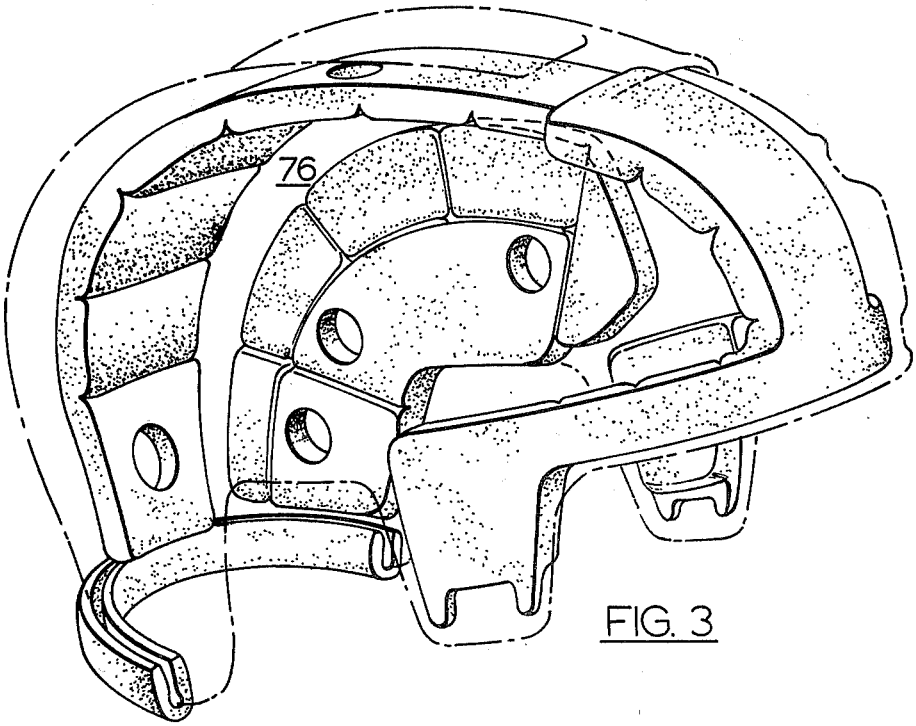
FIG. 3 is a perspective view of portions of protective padding in the helmet showing the helmet in ghost outline about the padding.

The helmet 22 and mouth guard 24 include cooperating portions which are generally aligned vertically. The helmet 22 includes a peripheral brow portion 66 and the mouth guard includes an upper peripheral portion 68. The curvature of the portions 66, 68 correspond generally to that of the eye shield 26 so that on assembly the mouth guard and eye shield are in the relative positions shown in FIG. 2. It will be seen that the eye shield 26 is attached over the mouth guard such that the eye shield overlies the portions 66, 68 of the helmet and mouth guard. Consequently, air can move under the eye shield 26 as indicated by the arrows. Particularly when the user is moving as he would on ice skates there is a forced ventilation caused by air entering under the eye shield and exiting above the eye shield. This movement of air is facilitated further by openings 70 in the front of front shell 28, openings 72 in the central portion 36 of the shell 28, and further openings 74 provided in a contoured portion of the rear shell 30. Consequently it is possible for air to enter under the eye shield and to exit either from above the eye shield or continue to the rear of the helmet before exiting through openings 74. This air movement is facilitated by the arrangement of padding and by the contoured shape of the helmet. As seen in FIG. 3, the padding in the helmet rear shell 30 is arranged to provide an air space 76 adjacent the openings 74, and similarly padding in the front shell 28 is arranged to provide clearance for openings 72 and 70 so that further air can enter openings 70 and 72 and move rearwardly to cool the user's scalp.

Figure 4:
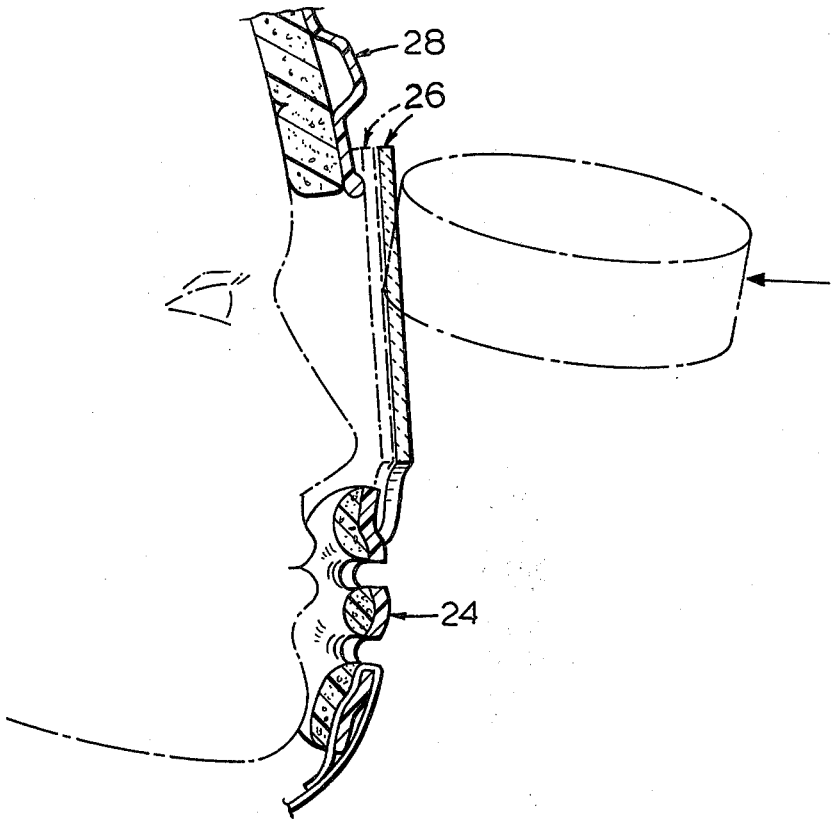
FIG. 4 is a sectional side view of a front portion of the assembled protective head gear and illustrating the effect of an impact by a puck on the eye shield.

The combination of peripheral brow portion 66 on the helmet 22 and upper peripheral portion 68 of the mouth guard 24 permits the use of a two dimensionally curved eye shield such as eye shield 26. The mouth guard prevents a hockey stick or the like penetrating upwardly between the eye shield 26 and the user's face and at the same time, if the eye shield were impacted by a puck as indicated in FIG. 4, the deflection of the eye shield into the position shown in ghost outline would result and the eye shield would then be supported by the helmet and mouth guard. Further, because of the padding on the helmet and mouth guard the force of the impact will not be transmitted locally to the user's head.

The shape of eye shield 26 can vary but is preferably such that major portions of the upper and lower peripheries would be supported on impact. Consequently, a preferred shape is shown in FIG. 1 and consists of a two dimensionally curved front portion 78 terminating in rearwardly extending side portions 80 containing openings 50 for attachment to the helmet and mouth piece as previously described. The lower periphery is contoured to correspond to that of the mouth guard except for a central lower portion which is contoured upwardly to provide an opening above the mouth guard for better ventilation and to allow exhalation from the user's nose to leave the head gear thereby limiting the possibility of fogging inside the eye shield.

It will be appreciated that the helmet and mouth guard can take many forms consistent with providing the necessary peripheral brow portion 66 and upper peripheral portion 68 for supporting the eye shield 78. In the preferred embodiment the eye shield is spaced from the portions 66, 68 for better ventilation. However, this spacing is not essential and could be omitted at the expense of this ventilation. In general, although the eye shield can take a number of different forms, it should relate to the aforementioned portions so that the eye shield will be supported by these portions on impact.

What I claim is:

1. Protective head gear of a type used in hockey and other activities to protect a participant against harmful and damaging impacts, the protective head gear comprising:

a helmet adapted to cover major portions of the participant's head other than his face, the helmet having symmetrically disposed temple portions at either side of the helmet, and a peripheral brow portion extending between the temple portions, the brow portion being normally positioned in use to extend across the participant's brow above the eyes;

a mouth guard comprising: a front portion for protecting a user's mouth; and a pair of wing portions extending from the front portion symmetrically rearwards and upwardly, said wing portions being attached to the temple portions, the front portion and wing portions defining an upper peripheral portion aligned generally vertically with said peripheral brow portion when in use; and an eye shield attachable to the temple portions and curved symmetrically outwards, at least major portions of the respective upper and lower peripheries of the eye shield overlying the peripheral brow portion of the helmet and the upper peripheral portion of the mouth guard during use so that on impact the eye shield will be supported by one or more of these portions.

2. Protective head gear as claimed in claim 1 in which the eye shield is adapted to cover the peripheral brow portion and the upper peripheral portion in spaced relation thereto sufficient to permit air circulation over the inside of the eye shield during use and such that on impact the eye shield will deflect into contact with one or more of these portions to support the eye shield.

3. Protective head gear as claimed in claim 1 in which the helmet defines openings to enhance the movement of air through the helmet.

4. Protective head gear as claimed in claim 1 in which the helmet further comprises a chin strap and means connecting the chin strap to the helmet, and in which the mouth guard includes a strap extending from the centre of the mouth guard rearwardly to a connection with the chin strap.

5. A helmet as claimed in claim 1 in which the helmet is adjustable to a user's head.

6. Protective head gear of a type used in hockey and other activities to protect a participant against harmful and damaging impacts, the protective head gear comprising:

a helmet adapted to cover major portions of the participant's head other than his face, the helmet having symmetrically disposed temple portions at either side of the helmet, and a peripheral brow portion extending between the temple portions, the brow portion being normally positioned in use to extend across the participant's brow above the eyes;

a mouth guard comprising: a front portion for protecting a user's mouth; and a pair of wing portions extending from the front portion symmetrically rearwards and upwardly, said wing portions being attached to the temple portions, the front portion and wing portions defining an upper peripheral portion; and, an eye shield attachable to the temple portions and curved symmetrically outwards, at least major portions of the respective upper and lower peripheries of the eye shield overlying the peripheral brow portion of the helmet and the upper peripheral portion of the mouth guard during use so that on impact the eye shield will be supported by one or more of these portions.

7. Protective head gear as claimed in claim 6 in which the eye shield is adapted to cover the peripheral brow portion and the upper peripheral portion in spaced relation thereto sufficient to permit air circulation over the inside of the eye shield during use and such that on impact the eyeshield will deflect into contact with one or more of these portions to support the eye shield.

8. Protective head gear as claimed in claim 6 in which the helmet defines openings to enhance the movement of air through the helmet when in use, the temple portions being adapted to receive a curved eye shield with portions of the eye shield overlying the peripheral brow portion of the helmet, and the upper peripheral portion of the mouth guard during use so that on impact the eye shield will be supported by one or more of these portions.

9. A helmet as claimed in claim 6 in which the helmet is adjustable to a user's head.

10. Protective head gear of a type used in hockey and other activities to protect a participant against harmful and damaging impacts, the protective head gear comprising:

a helmet adapted to cover major portions of the participant's head other than his face, the helmet having symmetrically disposed temple portions at either side of the helmet, and a peripheral brow portion extending between the temple portions, the brow portion being normally positioned in use to extend across the participant's brow above the eyes;

a mouth guard comprising: a front portion for protecting a user's mouth; and a pair of wing portions extending from the front portion symmetrically rearwards and upwardly, said wing portions being attached to the temple portions, the front portion and wing portions defining an upper peripheral portion aligned generally vertically with said peripheral brow portion when in use for combining with the brow portion, an eye shield which is attachable to the temple portions and curved symmetrically outwards so that at least major portions of the respective upper and lower peripheries of the eye shield overlie the peripheral brow portion of the helmet and the upper peripheral portion of the mouth guard so that on impact the eye shield will be supported by one or more of these portions.

* * * * *